US005979855A

United States Patent [19]

Maier

[11] Patent Number: 5,979,855

[45] Date of Patent: Nov. 9, 1999

[54] EASEL

[76] Inventor: Michael Lynn Maier, 1392 Southfork Rd., Cody, Wyo. 82414

[21] Appl. No.: 08/976,968

[22] Filed: Nov. 24, 1997

[51] Int. Cl.[6] ..... A47B 97/04

[52] U.S. Cl. ..... 248/441.1; 248/448

[58] Field of Search ..... 248/441.1, 448, 248/452, 447.1; 312/231

[56] References Cited

U.S. PATENT DOCUMENTS

| | | | |
|---|---|---|---|
| 2,333,353 | 11/1943 | Zanella | 248/452 |
| 3,061,969 | 11/1962 | Lunday | 248/448 |
| 3,095,665 | 7/1963 | Killen | 248/449 |
| 3,140,558 | 7/1964 | Cassidy | 248/449 |
| 3,991,967 | 11/1976 | Sack | 248/448 |
| 4,181,282 | 1/1980 | Oliver et al. | 248/448 |
| 4,436,271 | 3/1984 | Manso | 248/460 |
| 5,393,029 | 2/1995 | Senko | 248/447 |
| 5,433,415 | 7/1995 | Samson et al. | 248/448 |
| 5,580,024 | 12/1996 | Brice | 248/444.1 |
| 5,655,651 | 8/1997 | Maier | 206/1.7 |

*Primary Examiner*—Ramon O. Ramirez
*Assistant Examiner*—Anita M. King
*Attorney, Agent, or Firm*—Risto A. Rinne, Jr.

[57] ABSTRACT

An apparatus for retaining an artist panel is described as including a planar surface with a pair of slots formed therein and a pair of retaining members protruding through the pair of slots a sufficient amount to engage an artist panel. Each of the pair of retaining members is adjustable in position along the length of each of the pair of slots, respectively. The first of the pair of retaining members, when adjusted, provides a fixed abutment. The remaining retaining member includes a spring which supplies a force tending to urge it toward the first retaining member. The panel is secured to the planar surface by the tension supplied to it by the force imparted by the remaining retaining member that is then transferred through the panel and to the first retaining member as well. The pair of retaining members are adjusted in position by a corresponding pair of thumbscrews that are disposed on a cover plate that is attached to the underside of the planar surface. Each of the pair of thumbscrews cooperates with a third and a fourth slot that are provided in the cover plate.

20 Claims, 4 Drawing Sheets

EASEL

BACKGROUND OF THE INVENTION

1. Field of the Invention

The present invention, in general, relates to artist supplies and, more particularly, to easels for holding a panel during painting.

Easels are, of course well known. There are many styles and sizes of easels that are useful for a number of purposes.

However, artists have a need for an easel with special features. Often an artist will travel to a site and make either a sketch or an actual painting. He may not know in advance exactly what size panel he is going to use. The size of panel to be used will vary depending upon what image presents itself to the artist and his imagination. He may take along several different sizes of panels and then decide at each site which one he will use.

Therefore an easel that is adapted to hold different size panels is a useful device.

Sometimes, the panel will actually have a greater width than that of the easel. Therefore an easel that is adapted to hold a panel that is larger than the easel itself is, at times, especially useful.

Furthermore, in addition to merely holding the panel, it is desirable to secure the panel to the easel. This is useful because as the artist makes brush strokes upon the panel, a panel that is secured to the easel is less likely to move, thus making it easier to inscribe the envisioned image thereupon.

Therefore, an easel that is adapted to secure the panel thereto is also a useful device.

Furthermore, another problem arises in trying to secure a panel to an easel in that the means to hold the panel in place may interfere with the actual brush strokes.

There may be an obstruction presented by the mechanism which secures the panel so that an artist cannot make a free-flowing brush stroke in the area. This inhibits use of the panel by the artist.

The mechanism to secure the panel may also make contact with a brush the artist is using in such a manner so as to "squeegee" (i.e.; squeeze) paint off of the brush. This is more likely to happen when a large surface is exposed above the panel in direct line with the brush strokes. The large surface tends to scrape the paint off of the brush as contact is made. When this happens it causes paint to accumulate and to run down the panel, sometimes doing considerable damage to the work in process.

Ideally the method to hold the panel to the easel should not pose any large protruding piece that could then interfere with the brush strokes by the artist or squeegee a significant quantity of paint off of the brush.

Another requirement is that the easel, including any mechanism to hold the panel thereto, be pleasing in appearance. An artist is endeavoring to create a work of art that is a thing of beauty. That objective can hardly be aided if there is ugliness in any of the supplies and equipment which the artist uses.

Quite the contrary is true. An easel that is pleasing in appearance, especially when viewed from all angles, contributes to the beauty of the work in process by helping to keep the artist inspired and filled with thoughts of beauty and perfection.

This is not a minor point to consider. Indeed the artist sees the easel every time his gaze moves from the scene he is painting to the actual work in process. If the easel is generally appealing in appearance the inspired state of mind of the artist is maintained during the many transitions back and forth between the painting and the actual scene.

Therefore much thought and ingenuity are necessary to create an easel that is both functionally and aesthetically correct. If the easel satisfied only the functional requirements, it would neither contribute to great works of art nor would it be well accepted by professional artists.

Accordingly there exists today a need for an easel that is adapted to hold different size panels, to secure the panel to the easel including a panel that is larger than the easel itself, and which does not significantly interfere with the brush strokes of the artist, and is also pleasing in appearance.

Clearly, such an apparatus is a useful and desirable device.

2. Description of Prior Art

Easels are, in general, known. For example, the following patents describe various types of these and similar types of devices:

U.S. Pat. No. 1,175,070 to Maxwell, Mar. 14, 1916;
U.S. Pat. No. 1,221,510 to Christensen, Apr. 3, 1917;
U.S. Pat. No. 2,515,703 to Dumas, Jul. 18, 1950;
U.S. Pat. No. 2,648,933 to Brooks et al, Aug. 18, 1953;
U.S. Pat. No. 2,867,928 to Angell, Jan. 13, 1959;
U.S. Pat. No. 2,940,200 to Endlich, Jun. 14, 1960;
U.S. Pat. No. 3,672,742 to Barg, Jun. 27, 1972;
U.S. Pat. No. 4,061,224 to Fuhri, Dec. 6, 1977;
U.S. Pat. No. 4,372,630 to Fuhri, Feb. 8, 1983;
U.S. Pat. No. 5,163,547 to Hsieh, Nov. 17, 1992;
U.S. Pat. No. 5,348,144 to Maier, Sept. 20, 1994; and,
U.S. Pat. No. 5,655,651 to Maier, Aug. 12, 1997.

While the structural arrangements of the above described devices, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide an easel that is adaptable to receive a panel.

It is an important object of the invention to provide an easel that is adaptable to receive panels of varying size.

Another object of the invention is to provide an easel that can secure a panel thereto.

Another important object of the invention is to provide an easel that can secure a panel that is larger than the easel thereto.

Still another object of the invention is to provide an easel that can secure a panel thereto while presenting a minimal obstruction to impinge upon the brush of an artist during use.

Still yet another object of the invention is to provide an easel that the tension by which a panel is held in place can be varied.

Yet another important object of the invention is to provide an easel having a mechanism to hold a panel thereto that is compact.

Still yet another important object of the invention is to provide an easel having a mechanism to hold a panel thereto that is pleasing in appearance.

One further object of the invention is to provide an easel that is adaptable for cooperative use with a palette.

One still further object of the invention is to provide an easel that is adaptable for cooperative use with an artist sketch box.

Briefly, an easel for use by an artist that is constructed in accordance with the principles of the present invention has a first slot formed through the easel on a first side thereof and a second slot formed through the easel on a second side opposite the first side and includes means for retaining a panel, wherein the means for retaining cooperates with the first and second slots. The means for retaining includes a first assembly that is adjustable along a third slot formed in the means for retaining, the first assembly providing a first retaining member adapted to protrude through the first slot an amount sufficient to engage a first side of the panel. The means for retaining includes a second assembly that is adjustable along a fourth slot formed in the means for retaining, the second assembly providing a second retaining member that includes a spring that supplies a force to urge it toward the center of easel. The second retaining member is adapted to protrude through the second slot an amount sufficient to engage a second side of the panel disposed on the opposite side with respect to the first side thereof and to supply a force thereto to urge the panel into a position of cooperative tension arising between the first retaining member and the second retaining member.

DETAILED DESCRIPTION OF THE INVENTION

Figure 1:
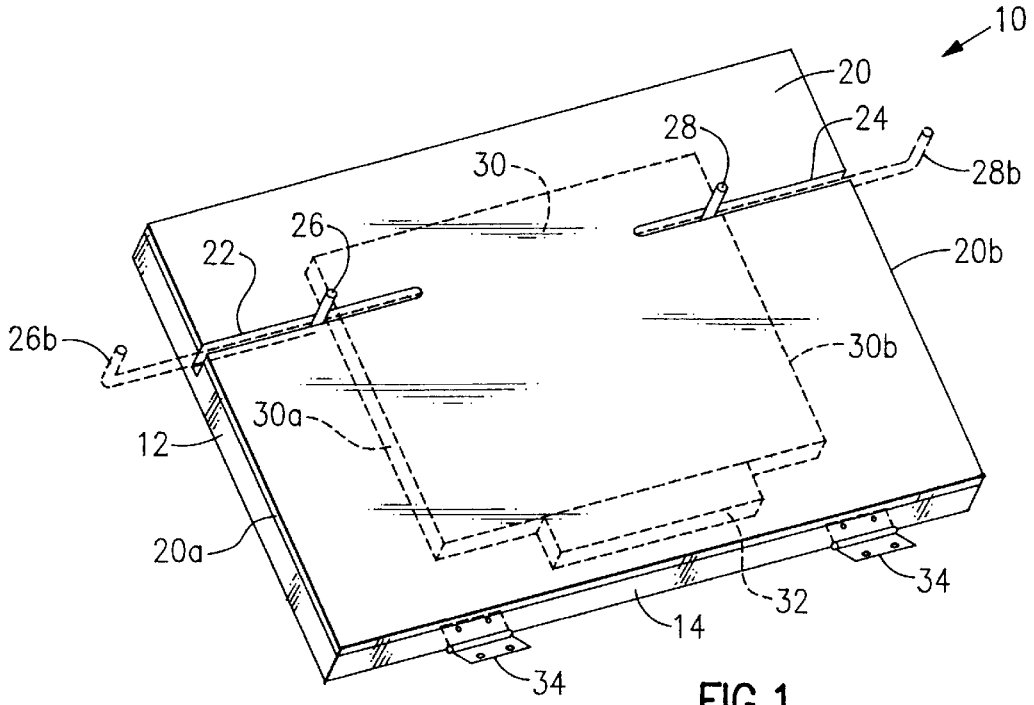
FIG. 1 is a view in perspective of the front surface of an easel constructed in accordance with the invention.

Referring primarily to FIG. 1 and on occasion to FIGS. 1–6 is shown, an easel, identified in general by the reference numeral 10.

The basic construction of the easel 10 is that of an open-ended box including a first side member 12, a second side member 14, a third side member 16, a fourth side member 18, and a cover member 20 disposed over the first, second, third, fourth members 12, 14, 16, 18 and forming a planar surface therebetween.

The first, second, third, fourth members 12, 14, 16, 18 and the cover member 20 are attached to each other as preferred so as to provide sufficient structural integrity to the basic easel 10. The component parts of the easel 10 are constructed of whatever material is preferred, and attached to each other by whatever method is preferred.

For example, the first, second, third, fourth members 12, 14, 16, 18 and the cover member 20 are formed of wood and joined by adhesives and fasteners according to one preferred embodiment. According to another embodiment of these same component parts they are formed of plastic as a contiguous piece. These variations are mentioned only to illustrate that there are many anticipated ways of bringing forth the invention as it is described herein.

A first slot 22 is formed through a first side 20*a* of the cover member 20 and into the first side member 12 to a predetermined depth.

A second slot 24 is formed through a second side 20*b* of the cover member 20, the second side 20*b* being disposed on the opposite side with respect to the first side 20*a* and into the third side member 16 to a predetermined depth.

The first slot 22 and the second slot 24 are aligned, generally, on the same plane across the easel 10 so as to form, if connected together, a line. (According to an alternative embodiment, as is described in greater detail hereinafter, two modified slots are parallel with respect to each other but are not disposed on the same line.) It is possible to connect the first slot 22 and the second slot 24 so as to form a continuous slot (not shown) across the cover member 20 and this modification can be accomplished if it is desirable to provide an even greater range of adjustability for the easel 10. The adjustability of the easel 10 is described in greater detail hereinbelow.

The advantage in providing both the first slot 22 and the second slot 24 is that there is no interference between the component parts that are associated with each of the first and second slots 22, 24, as is described in greater detail hereinbelow. Also, it makes understanding the invention easier to comprehend and, for an artist, it makes it easier to use.

The word "slot" is used throughout this description. For the purpose of this specification, a slot is defined as an opening having a length that is greater than its width. Motion appertaining to components disposed within the slot refer to longitudinal motion along the length, or longer dimension, of the slot.

A first retaining member 26 extends from the back of the easel 10 through the first slot 22 and protrudes above the plane of the cover member 20. Detail as to the construction of the first retaining member 26 is described in greater detail hereinbelow.

A second retaining member 28 extends from the back of the easel 10 through the second slot 24 and protrudes above the plane of the cover member 20. Detail as to the construction of the second retaining member 28 is also described in greater detail hereinbelow.

An optional panel 30, shown in dashed lines in the FIG. 1 drawing, is disposed intermediate the first retaining member 26 and the second retaining member 28. The panel 30 is the surface upon which an artist paints a painting or makes a sketch. Detail, as to how the panel is secured thereto, is discussed in greater detail hereinbelow.

U.S. Pat. No. 5,348,144 to Maier, which issued on Sep. 20, 1994; and U.S. Pat. No. 5,655,651 to Maier, which issued on Aug. 12, 1997 provide useful relevant teachings and are incorporated by reference herein.

An optional lower supporting lip 32, also shown in dashed lines in the FIG. 1 drawing, is disposed intermediate the panel 30 and the second side member 14. The lower supporting lip 32 is attached to, and protrudes above, the plane of the cover member 20. It provides a lower abutment to secure the panel 30 at the desired elevation above a longitudinal length of the second side member 14. The lower supporting lip 32 may, alternatively, be attached to the second side member 14, if preferred. U.S. Pat. No. 5,655,651 to Maier, which issued on Aug. 12, 1997 provides additional relevant teachings in its discussion of a panel support shelf (column 4, lines 18–21).

A pair of hinges 34, also shown in dashed lines in the FIG. 1 drawing, are optional depending upon how the easel 10 is to be used. The pair of hinges 34, as shown, are attached through the cover member 20 and to the second side member 14.

If preferred, the pair of hinges 34 is attached either directly to the first, second, third, or fourth member 12, 14, 16, 18, or is attached to any of these members 12, 14, 16, 18 with the cover member 20 disposed intermediate thereto.

The pair of hinges 34 are used to attach the easel 10 to another object (not shown) as desired. The object may include, among others, either a palette or an artist sketch box. U.S. Pat. No. 5,348,144 to Maier, which issued on Sep. 20, 1994; and U.S. Pat. No. 5,655,651 to Maier, which issued on Aug. 12, 1997 illustrate such attachments.

If preferred, a mounting thread receptacle (not shown) is attached where desired to the easel 10 and the easel 10 is secured to a tripod (not shown) by attachment to the mounting thread receptacle. The mounting thread receptacle typically includes female ¼ by 20 size machine screw threads to accommodate standard tripod mounting screw threads. Refer to U.S. Pat. No. 5,655,651 to Maier for a further teaching of tripod mountings on a palette that is pivotally attached to an easel (column 4, lines 10–14). The mounting thread receptacle, as discussed above, is alternatively attached directly to the easel 10, where desired.

Conversely, as preferred the easel 10 does not include the pair of hinges 34 and is used as a free standing unit that may be held by the artist during use or placed upon a table (not shown) or other type of support surface.

Referring primarily now to FIG. 2 through FIG. 5 is shown a first thumbscrew 36 and a second thumbscrew 38. The first thumbscrew 36 passes through a third slot 40. The second thumbscrew 38 passes through a fourth slot 42.

The third slot 40 and the fourth slot 42 are formed through a first angled surface 44 and through an oppositely disposed second angled surface 46 of a cover plate 48, respectively. The cover plate 48 includes a center surface 50 that is parallel with respect to the plane of the cover member 20 and is elevated above the cover member 20 an amount which approximates the depth of any of the first, second, third, or fourth members 12, 14, 16, 18.

On opposite longitudinal sides of the center surface 50 of the cover plate 48, the first angled surface 44 extends down toward the cover member 20 on one side and the second angled surface 46 similarly extends down toward the cover member 20 on the opposite side at a complimentary angle with respect to the first angled surface 44.

Ideally, the first angled surface 44 is disposed at approximately a forty-five degree angle with respect to the plane of the center surface 50. To continue measuring from the same reference line, the second angled surface 46 is disposed at approximately a one-hundred and thirty-five degree angle with respect to the plane of the center surface 50.

Therefore, the first angled surface 44 is disposed at approximately a ninety degree angle with respect to the second angled surface 46. This angular relationship is not critical.

Ideally, the angles chosen for the first angled surface 44 and for the second angled surface 46 are selected so that the first thumbscrew 36 and the second thumbscrew 38 do not extend significantly above the plane of the center surface 50.

This is to maintain a compact overall shape for the easel 10. A thin, compact shape facilitates use of the easel 10 when the easel 10 is inserted into an artist sketch box (not shown) or pivotally attached to a palette (not shown).

A first lower surface 52 is attached to the first angled surface 44 and extends therefrom on a lower plane that is parallel with respect to the center surface 50. A second lower surface 54 is similarly attached to the second angled surface 46 and extends therefrom on a plane that is parallel with respect to the first lower surface 52. The first lower surface 52 and the second lower surface 54 may be attached to the cover member 20 as desired to secure the cover plate 48 thereto.

Figure 3:
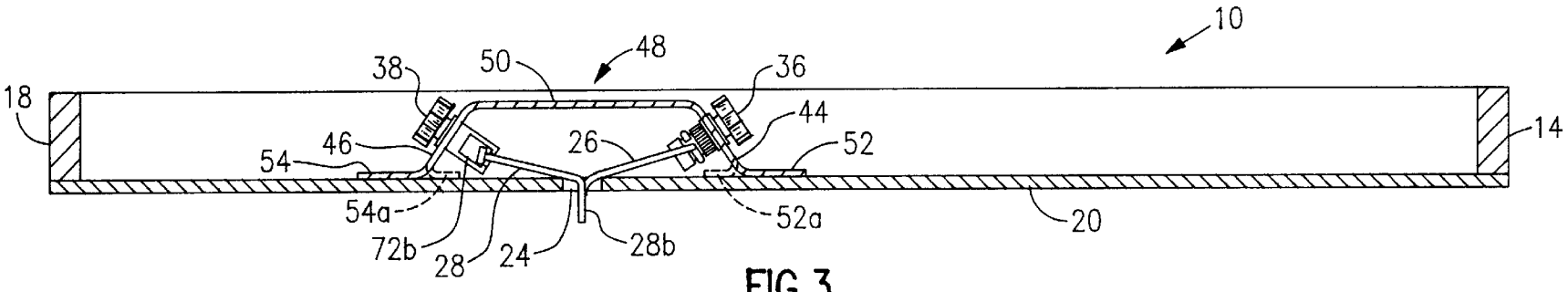
FIG. 3 is a cross sectional view taken on the line 3—3 in FIG. 2.

The first lower surface 52 and the second lower surface 54 may extend outward as shown or inward as is shown in dashed lines and identified by the reference numerals 52*a* and 54*a* respectively in the FIG. 3 drawing. Although it may be somewhat more difficult to obtain the inward orientation, a more pleasing appearance and the elimination of two sharp edges is achieved.

Figure 2:
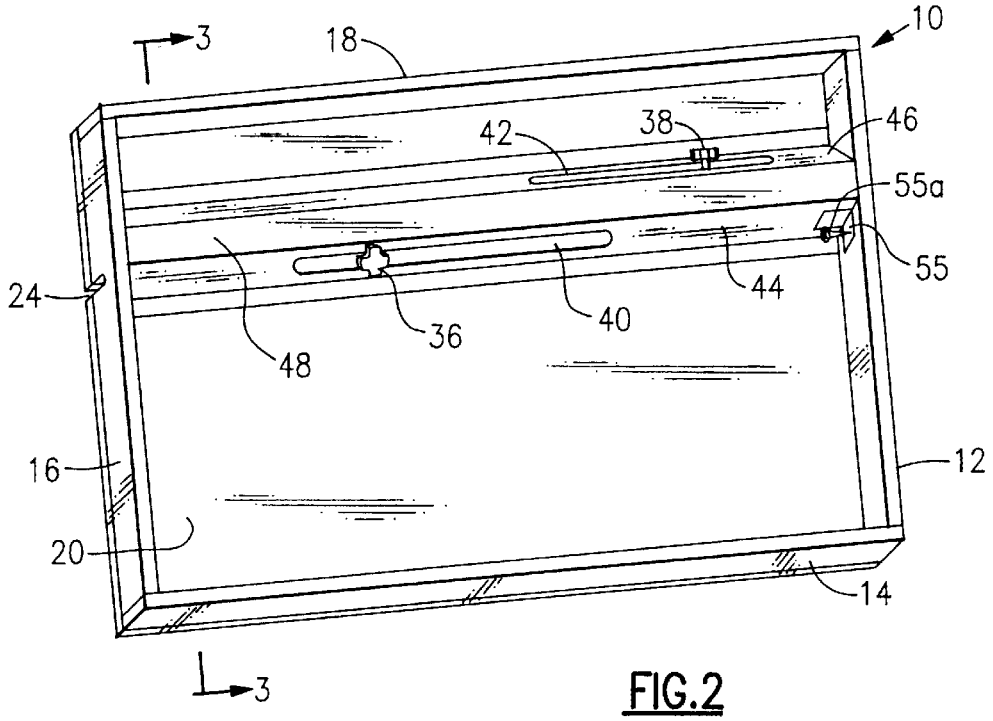
FIG. 2 is a view in perspective of the underside of the easel as shown in FIG. 1.

Referring momentarily to FIG. 2, a mounting tab 55 and a mounting tab screw 55*a* are shown. The mounting tab 55 is a portion of the cover plate 48 that is bent perpendicular to the plane of the center surface 50. The mounting tab screw 55*a* passes through a hole in the mounting tab 55 and secures the cover plate 48 to the first side member 12. The mounting tab 55 and the mounting tab screw 55*a* represent one of four such mounting tab arrangements. Two of the remaining three (not shown) are disposed on each end of the cover plate 48 on opposite sides. Two are adjacent the first side member 12 and two are adjacent the third side member 16. The remaining three are secured thereto by other mounting tab screws (not shown).

The first lower surface 52, the second lower surface 54, the first angled surface 44, the second angled surface 46, and the center surface 50 are preferably formed from a single piece of material, such as from brass plate that is bent as required to produce the cover plate 48. As appearance is an important consideration of the easel 10, brass is especially appealing in this regard.

Figure 4:
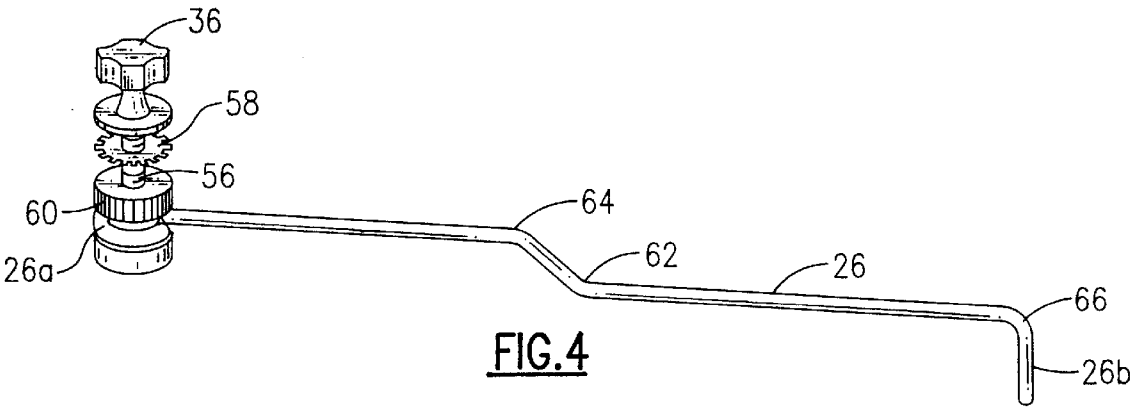
FIG. 4 is a view in perspective of a first assembly used for retaining a first side of a panel to the easel.

Referring primarily to FIG. 4, the first thumbscrew 36 includes a first threaded portion 56 and a first lock washer 58 disposed over the first threaded portion 56 and adjacent to the first thumbscrew 36. A first thumbscrew nut 60 is provided which includes female threads adapted to cooperate with those of the first threaded portion 56.

The first retaining member 26 is attached at a first end 26*a* to the first thumbscrew nut 60. A method of attachment is to encircle the first thumbscrew nut 60, as shown, and to solder or braze the first end 26*a* thereto.

The first retaining member 26 includes a second end 26*b* that is distally disposed with respect to the first end 26*a*. The second end 26*b* includes that portion of the first retaining member 26 that protrudes above the surface of the cover member 20.

Intermediate the first end 26*a* and the second end 26*b* is a first bend 62 and a second bend 64 formed into the first retaining member 26. The first bend 62 and the second bend 64 are useful to position the first retaining member 26 under the cover plate 48 in order to optimally align the second end 26*b* with the first slot 22.

The third slot 40 is disposed intermediate the first thumbscrew nut 60 and the first lock washer 58. The first thumbscrew 36 is loosened and urged longitudinally along the third slot 40 until the second end 26*b* protrudes from the first slot 22 where desired. The first thumbscrew 36 is then tightened thus securing the first retaining member 26 in position. The second end 26*b* of the first retaining member 26 provides a fixed abutment which determines the position of a first side 30*a* of the panel 30.

It is noted that the second end 26*b* of the first retaining member 26 can be positioned so as to provide a fixed abutment that extends off of (beyond) the side of the easel 10. This is useful to secure a special panel (not shown) that is actually wider than the easel 10 thereto and is shown in dashed lines in the FIG. 1 drawing.

As the first retaining member 26 is a contiguous piece, the second end 26*b* is held in the proper position which is generally perpendicular with respect to the plane of the cover member 20. A third bend 66 is provided in the first retaining member near to the second end 26*b* to orient the second end 26*b* as desired in a near perpendicular orientation.

Together, the first thumbscrew 36, the first threaded portion 56, the first lock washer 58, the first thumbscrew nut 60, and the first retaining member 26 comprise a first assembly useful to hold the panel 30 to the easel 10.

Figures 5, 8:
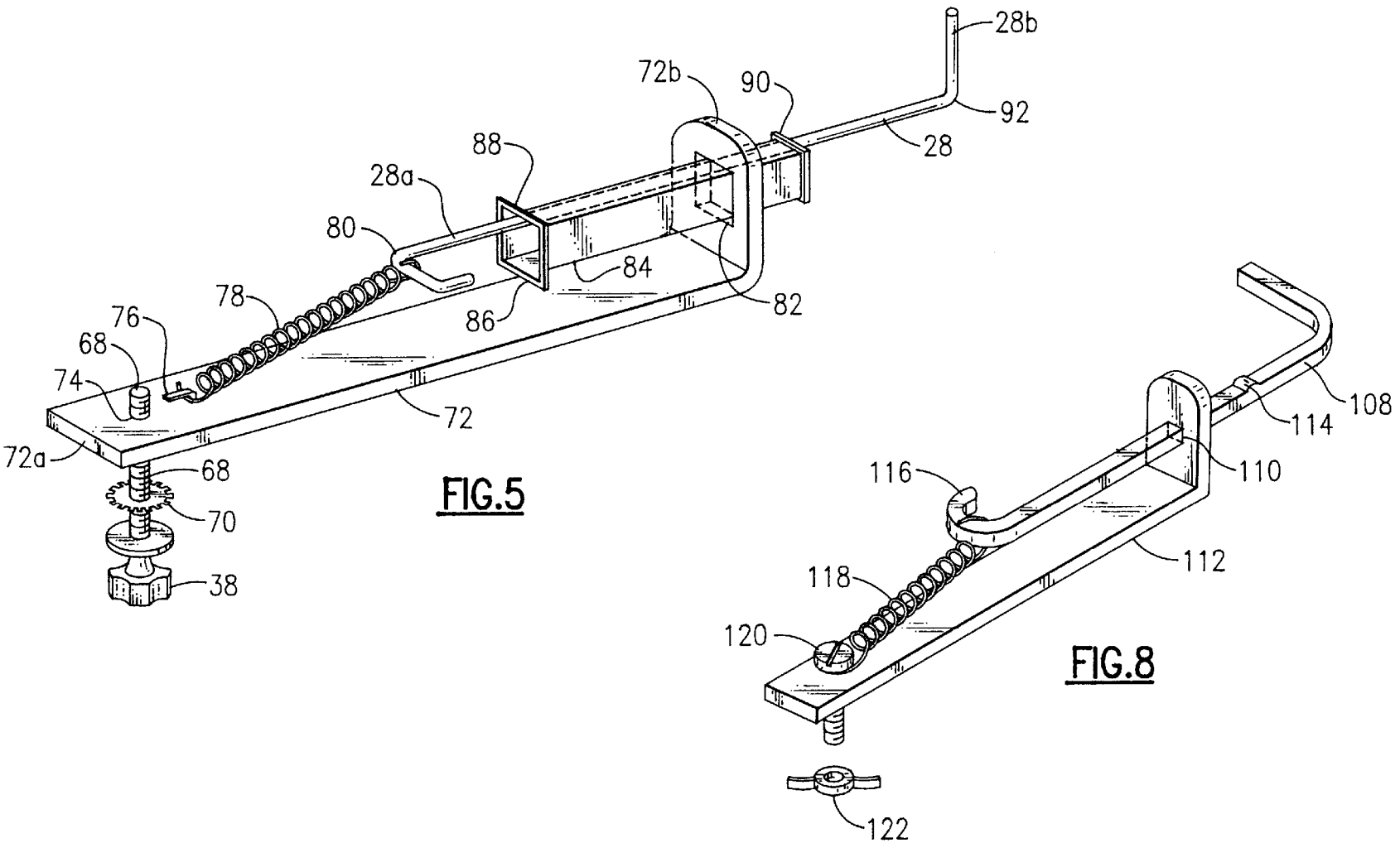
FIG. 5 is a view in perspective of a second assembly used for retaining a second side of a panel to the easel.
FIG. 8 is a view in perspective of a modified second assembly used for retaining a second side of a panel to the modified easel of FIG. 7.

Referring primarily to FIG. 5, the second thumbscrew 38 includes a second threaded portion 68 attached thereto and a second lock washer 70 that is disposed over the second threaded portion 68 and adjacent to the second thumbscrew 38.

A bracket 72 includes a first bracket end 72*a* and a distal second bracket end 72*b*. The distal second bracket end 72*b* includes a planar surface that is disposed at a ninety degree angle with respect to the planar surface of the bracket 72, in general.

A hole 74 is provided near the first bracket end 72*a* which includes female threads adapted to cooperate with male threads of the second threaded portion 68.

A hook 76 is attached to the bracket 72 near the hole 74 and is used to retain a first end of a spring 78. The remaining end of the spring 78 is attached to a second hook 80 that is formed at a proximal end 28*a* of the second retaining member 28. The construction and attachment of the second retaining member 28 is described in greater detail hereinbelow.

The distal second bracket end 72*b* includes a rectangular opening 82. Disposed within the rectangular opening 82 and adapted for slideable motion therein is a rectangular tube 84.

The rectangular tube 84 is of a similar cross sectional area and profile as is the rectangular opening 82 except it has outside dimensions that are less than the inside dimensions of the first rectangular opening 82. Accordingly it is free to slide longitudinally back and forth within the rectangular opening 82.

The rectangular tube 84 includes a hollow center area 86, a first lip 88 disposed at an end of the rectangular tube 84 that is disposed nearest the hook 76, and a second lip 90 that is disposed at the opposite end thereof. Both the first lip 88 and the second lip 90 are attached to the rectangular tube 84 so as to extend from the surface of the rectangular tube 84 an amount which, when combined with the dimensions of the rectangular tube 84, exceed the dimensions of the rectangular opening 82, thereby containing the rectangular tube 84 within the rectangular opening 82.

The rectangular tube 84 is free to slide longitudinally back and forth within the rectangular opening 82 from end to end until engagement is made with either the first lip 88 or the second lip 90.

The second retaining member 28 includes a distal end 28*b* that is distally disposed with respect to the proximal end 28*a*. The distal end 28*b* includes that portion of the second retaining member 28 that protrudes above the surface of the cover member 20.

A fourth bend 92 is included in the second retaining member 28 to orient the distal end 28*b* perpendicular with respect to the plane of the cover member 20.

The second retaining member 28 is disposed within the rectangular tube 84 and, therefore, within the rectangular opening 82. The second retaining member 28 is attached to the rectangular tube 84 by whatever method is desired, such as by welding, brazing, or by the use of an adhesive.

The rectangular tube 84 and the rectangular opening 82 provide a cross sectional profile that precludes rotation about a longitudinal axis passing therein while still permitting motion to occur along the longitudinal length of the rectangular tube 84. As the second retaining member 28 is attached to the rectangular tube 84, it too is prevented from rotating about a longitudinal axis. Preventing rotation of the second retaining member 28 helps to maintain the distal end 28*b* perpendicular with respect to the plane of the cover member 20.

Together, the second thumbscrew 38, the second threaded portion 68, the second lock washer 70, the bracket 72, the spring 78, the rectangular tube 84, and the second retaining member 28 comprise a second assembly useful to hold the panel 30 to the easel 10.

The fourth slot 42 is disposed intermediate the hole 74 adjacent to the bracket 72 and the second lock washer 70. The second thumbscrew 38 is loosened and urged longitudinally along the fourth slot 42 until the distal end 28*b* protrudes from the second slot 24 where desired. The second thumbscrew 38 is then tightened thus securing the second retaining member 28 in position.

The distal end 28*b* of the second retaining member 28 provides an abutment which supplies a force to a second side 30*b* of the panel 30 that tends to urge the second side 30*b* toward the center of the easel 10 until the first side 30*a* of the panel 30 makes contact with the second end 26*b* of the first retaining member 26, thus securing the panel 30 therein.

The magnitude of the force supplied is dependent upon the size of the panel 30 and the positioning of both the first assembly and the second assembly because the closer the second end 26*b* of the first retaining member 26 is to the distal end 28*b* of the second retaining member 28, the greater the amount, for any given size of the panel 30, that the spring 78 will have to be extended. (Of course, the magnitude of the force supplied is also dependent upon the characteristics of the spring 78 that is used.)

A greater extension of the spring 78 increases the retaining force that is applied by the second retaining member 28 to the panel 30. Conversely, the further apart the first assembly is from the second assembly, the less force is applied to the panel 30. Of course the first assembly and the second assembly must be adjusted in position within the length of the third slot 40 and the fourth slot 42 so as engage the panel 30 while still causing at least some extension of the spring 78 to occur.

It is noted that the distal end 28*b* of the second retaining member 28 can be positioned so as to provide a spring-loaded abutment that extends off of (beyond) the side of the easel 10. This is useful to secure the special panel to the easel 10 and is shown in dashed lines in the FIG. 1 drawing.

After initial adjustment of the position of the first assembly and the second assembly has occurred, normally the panel 30 is inserted by first pushing it against the distal end 28*b* with a force sufficient to overcome the force supplied by the spring 78 thereby extending the spring 78 and moving the distal end 28*b* farther away from the second end 26*b* until there is sufficient clearance to place the entire panel 30 flat against the easel 10.

The spring 78 then supplies a force to the panel 30 to bring it back into contact with the second end 26*b* thus securing it in position. If the force applied to the panel 30 is deemed to be either too great or insufficient, then either the position of the first assembly, the second assembly, or both are adjusted until the proper tension is applied to the panel 30.

It is of course possible to begin by placing the panel 30 between the second end 26*b* and the distal end 28*b* and then adjust the position of either the first assembly or the second assembly or both until the desired tension is applied to the panel 30. The exact sequence for securing the panel 30 to the easel 10 is dependent upon the preference of the artist.

The bracket 72 is disposed adjacent to the inside surface of the second angled surface 46 when it is held in position by the second thumbscrew 38. As the second angled surface 46 is nearly at a forty-five degree angle with respect to the plane of the cover member 20, for the distal end 28*b* to be nearly perpendicular with respect to the plane of the cover member 20, the fourth bend 92 is a compound angle that orients the distal end 28*b* at approximately a ninety degree angle with respect to the longitudinal length of the second retaining member 28 and also at a forty-five degree angle with respect to the plane of the second angled surface 46.

In a similar fashion, the first bend 62, second bend 64, and the third bend 66 of the first retaining member 26 include therein at least one compound angle sufficient to orient the second end 26*b* of the first retaining member 26 at nearly a forty-five degree angle with respect to the first angled surface 44.

The length of the second end 26*b* of the first retaining member 26 or the length of the distal end 28*b* of the second retaining member 28 are varied as desired to protrude the desired amount above the surface of the panel 30. If it is desired, they can be cut or shortened by a user or purchased with different lengths. The objective is to limit the length of the second end 26*b* and the distal end 28*b* so that they do not create an obstruction that significantly extends above the surface of the panel 30 which the stroke of an artist brush (not shown) might encounter.

Accordingly, as described the easel 10 provides a method to secure a panel 30 thereto. The easel 10 also provides a method to secure panels (not shown) of different length and width by adjusting the positioning of the first and second assemblies. The easel 10 also provides a method of varying the tension by which the panel 30 is held in position. The easel 10 also provides a method to secure the panel 30 without creating an obstruction which might interfere with the free flow of brush strokes by the artist. Finally, the easel 10 accomplishes these objectives in a compact and eye pleasing manner. For example, the cover plate 48 and all component parts of the first assembly and the second assembly (with the possible exception of the spring 78) may be made of brass or have a brass like finish applied thereto.

Figure 6:
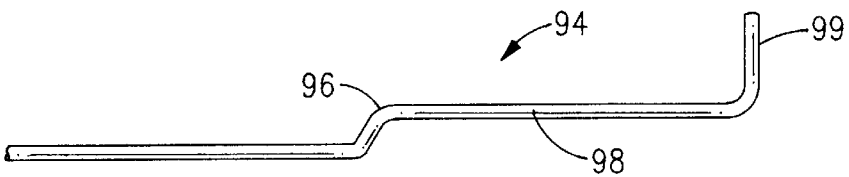
FIG. 6 is a view in perspective of a portion of a modified retaining member useful in securing a large panel to the easel.

Referring now also to FIG. 6, is shown a portion of a modified retaining member, identified in general by the reference numeral 94. For comparative purposes, this resembles one half of the second retaining member 28 with the addition of a special bend 96 although the inclusion of the special bend 96 applies equally as well to a modification made to the first retaining member 26.

The special bend 96 orients a section 98 of the modified retaining member 94 below the surface of the cover member 20 disposed in either the first slot 22 or the second slot 24. Accordingly, an upright portion 99 of the modified retaining member 94 extends above the plane of cover member 20 at a position that can extend to either the right or the left beyond the length of either the first slot 22 or the second slot 24 off of the easel 10.

This is useful to secure an especially large panel (not shown) that is much larger than the easel 10 to the easel 10. By varying the length of the section 98, as desired, the easel 10 is adaptable to retain the especially large panel having virtually any size thereto.

It is also noted that the second end 26*b*, the distal end 28*b*, and the upright portion 99 as shown are formed of material stock having, in general, a round cross sectional profile. This is because a round surface does not tend to squeeze paint off of the brush of the artist even if contact is inadvertently made by the brush with either the second end 26*b*, the distal end 28*b*, or the upright portion 99 during use.

The second end 26*b*, the distal end 28*b*, and the upright portion 99 may of course be formed of square of other cross-sectional stock as desired to satisfy considerations relating to strength, ease of manufacture, appearance, and the general functioning and use of the easel 10.

Figure 7:
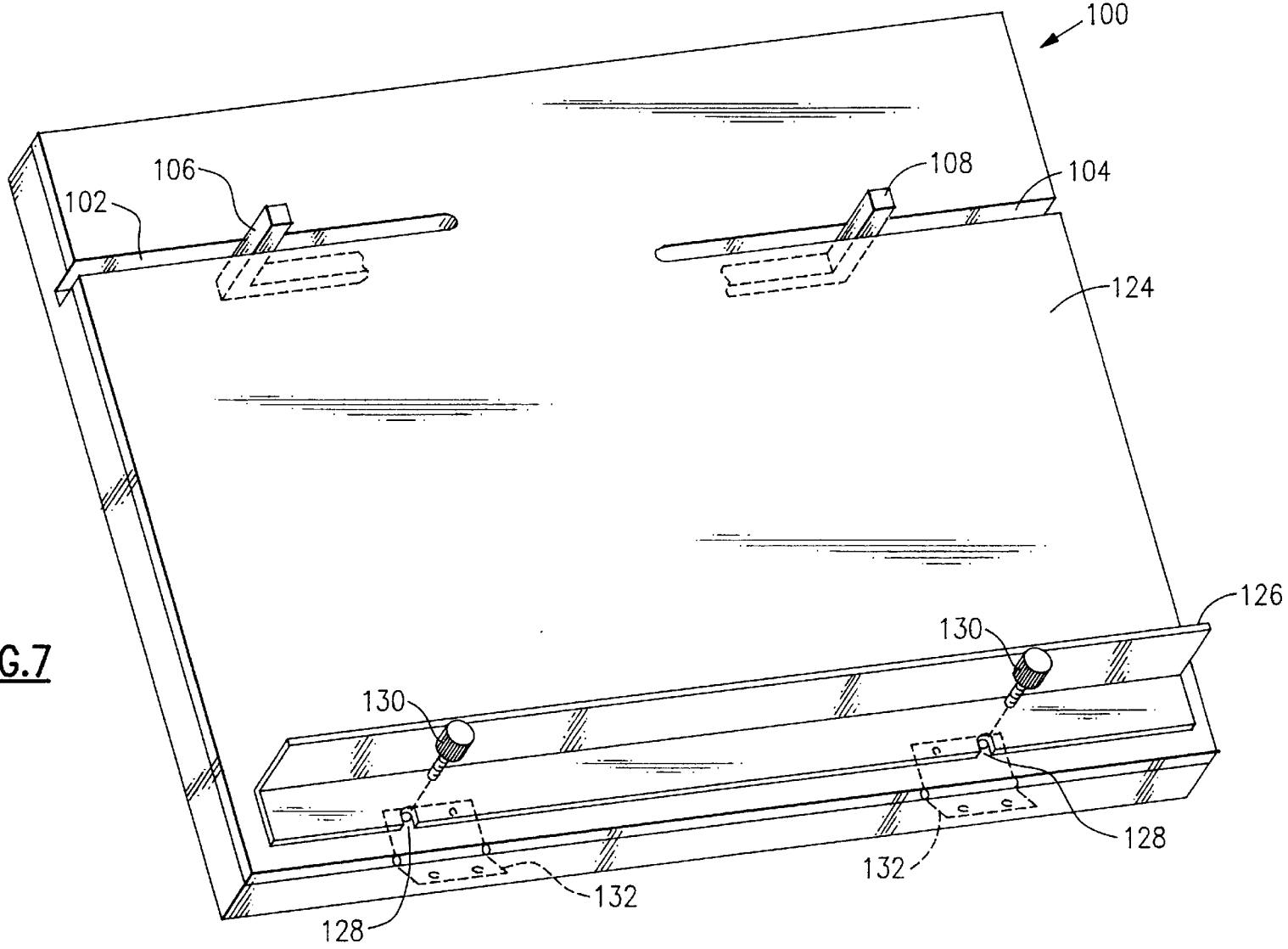
FIG. 7 is a view in perspective of the front surface of a modified easel that is also constructed in accordance with the invention.

Referring now to FIG. 7 is shown a modified easel 100. A first modified slot 102 and a second modified slot 104 are disposed on opposite ends of the modified easel 100 in parallel orientation with respect to each other but displaced away from each other a predetermined distance.

A portion of a modified first retaining member 106 is shown that is formed of a square stock and which also forms a fixed abutment that is constructed similar with respect to the first retaining member 26 except that is does not contain the first bend 62 nor does it contain the second bend 64 as the modified first retaining member 106 does not contact any part of a second modified assembly because the second modified assembly is not disposed on the same plane as that of the first modified slot 102. The second modified assembly is shown in FIG. 8 and is described in greater detail hereinbelow. A first modified assembly, which includes a first modified thumbscrew (not shown), modified nut (not shown) and the modified first retaining member 106, is disposed on the plane of the first modified slot 102.

A portion of a modified second retaining member 108 is shown that is formed of a square stock and which also forms a spring loaded abutment similar to that of the second retaining member 28 and the second assembly.

Referring to FIG. 8, the second modified member 108, being formed of square stock, passes through a square hole 110 that is formed in the modified bracket 112. A stop 114 limits retraction of the second modified member 108. The stop 114 may be formed if one were to peen the second modified member 108 so as to cause a distortion thereto that increases its size beyond that of the square hole 110 or the stop 114 may include any additional material that is attached to the second modified member 108 so as to increase its size beyond that of the square hole 110. The second modified member 108 includes a loop 116 that is formed at one end that is used to attach one end of a modified spring 118 thereto. The second modified member 108 having a square cross section is unable to rotate longitudinally within the square hole.

A modified screw 120 passes through the end of the modified bracket 112 that is disposed opposite that of the square hole 110 and is used to secure the remaining end of the modified spring 118 to the modified bracket 112 and also the bracket 112 to the fourth slot 42.

A T-nut 122 is provided and is used to tighten and secure the modified bracket 112 to the modified screw 120 and also to the fourth slot 42 of the cover plate 48. The T-nut 122 may be used in place of either the first thumbscrew 36 or the second thumbscrew 38, if preferred. Conversely, a conventional thumbscrew can be used instead of the T-nut 122 if preferred.

The advantage of the T-nut 122 is that it is, in general, easier to apply a force to either tighten or to loosen the T-nut 122 than it is the conventional thumbscrew. Together the T-nut 122, the modified screw 120, the modified spring 118, the modified bracket 112, and the second modified member 108 form the second modified assembly.

If desired, the T-nut 122, first thumbscrew 36, or second thumbscrew 38 may be eliminated and a cam-lock mechanism (not shown) may be used in their place. The cam-lock mechanism may be available off the shelf from various supply houses or custom designed for this application. In use a lever (not shown) is part of the cam-lock mechanism and a partial rotation of the lever either loosens or tightens either the first assembly, the second assembly, the modified first assembly, or the modified second assembly in position. The cam-lock mechanism would add expense to the easel 10 or to the modified easel 100 but would allow for faster adjustment and is a design selection prerogative that is based on the consumer market. In other words, for high-end product sales, the cam-lock mechanism can be used, if preferred.

The modified easel 100 provides easier manufacture for the component parts of the first and second modified assemblies as compared to those of the easel 10. Adjustment of the position of the first modified member 106 and the second modified member 108 by the artist is also enhanced as all motion is accomplished on the same line of the same plane, namely that of either the first modified slot 102 or the second modified slot 104, respectively. As they are on different lines, there is no interference.

The slight offset in appearance by having the first modified slot 102 and the second modified slot 104 disposed on lines that are on the same plane (of a modified cover member 124) but disposed apart from each other is considered negligible at this time, and this expression of the invention is therefore considered to be a best mode for bringing it forth.

Disposed near the bottom of the modified easel 100 is shown a support lip 126. The support lip 126 includes a pair of open-ended slots 128, as desired. A pair of hinge thumbscrews 130 are loosened and then tightened to secure the support lip 126 or to remove it from the modified easel 100. The support lip 126, as disclosed, can of course be used with easel 10.

The purpose of the support lip 126 is to provide a large lip that extends across the modified easel 100 and sufficiently far above the plane of the modified cover member 124 so as to provide not only a support surface for the bottom of the panel 30 (not shown in FIG. 7), but also which functions as a debris catcher.

When artists who work in the pastel media rely upon various chalk crayons, the debris left behind can accumulate and damage a work in progress. The artist must pivot the modified easel 100 about a pair of modified hinges 132 periodically to at least a vertical position and then tap the work in progress to loosen the debris from the chalk crayons which will slide down the panel 30. The support lip 126 catches this debris at the bottom of the panel 30. The open-ended slots 128 and the hinge thumbscrews 130 allow for quick installation and removal of the support lip 126.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. An easel adapted for securing a panel thereto, comprising:

(a) a planar surface;

(b) a first protrusion disposed on said planar surface, said first protrusion providing an abutment that is adapted to engage one side of said panel;

(c) a second protrusion disposed on said planar surface at a predetermined distance from said first protrusion, said second protrusion providing an abutment that is adapted to engage a second side of said panel that is disposed opposite with respect to said one side; and (d) means for urging said second protrusion toward said first protrusion;

whereby said panel is retained in position when it is disposed between said first protrusion and said second protrusion.

2. The easel of claim 1 including means for adjusting the position of said first protrusion.

3. The easel of claim 2 wherein said means for adjusting includes a first slot formed in said planar surface along which said first protrusion is positionable.

4. The easel of claim 1 including means for adjusting the position of said second protrusion.

5. The easel of claim 4 wherein said means for adjusting includes a second slot formed in said planar surface along which said second protrusion is positionable.

6. The easel of claim 1 including means for limiting the length of said first protrusion above said planar surface.

7. The easel of claim 1 including means for limiting the length of said second protrusion above said planar surface.

8. The easel of claim 1 wherein said means for urging includes a spring attached to said easel at one end thereof and to said second protrusion at the remaining end thereof, said spring adapted to supply a force to urge said second protrusion toward said first protrusion.

9. The easel of claim 1 including means for aligning said first protrusion in a generally perpendicular orientation with respect to said planar surface.

10. The easel of claim 1 including means for aligning said second protrusion in a generally perpendicular orientation with respect to said planar surface.

11. The easel of claim 10 wherein said means for aligning includes means adapted for cooperating with a bracket attached to said easel.

12. The easel of claim 11 wherein said means adapted for cooperating includes an opening through said bracket having a cross sectional profile that does not allow for rotation about a longitudinal axis passing through said opening and includes a member having a similar cross sectional profile disposed within said opening that is adapted for motion along said longitudinal axis and is precluded from significant rotation about said longitudinal axis, and wherein said member is attached to at least a portion of said second protrusion.

13. The easel of claim 12 wherein said opening and said member have a rectangular cross sectional profile.

14. An easel adapted for securing a panel thereto, comprising:

(a) a planar surface including a first slot and a second slot;

(b) a first retaining member including a first protrusion at one end thereof, said first protrusion disposed on said planar surface and extending through said first slot, said first protrusion providing an abutment that is adapted to engage one side of said panel;

(c) a second retaining member including a second protrusion at one end thereof, said second protrusion disposed on said planar surface at a predetermined distance from said first protrusion and extending through said second slot, said second protrusion providing an abutment that is adapted to engage a second side of said panel that is disposed opposite with respect to said one side; and (d) means for urging said second protrusion toward said first protrusion;

whereby said panel is retained in position when it is disposed between said first protrusion and said second protrusion.

15. The easel of claim 14 including a cover, said cover including a third slot and a fourth slot, said third slot adapted to receive a first thumbscrew therein and said fourth slot adapted to receive a second thumbscrew therein, said first thumbscrew providing means for adjusting the position of said first protrusion and said second thumbscrew providing means for adjusting the position of said second protrusion.

16. The easel of claim 15 wherein at least one of said first thumbscrew and said second thumbscrew includes a T-nut.

17. The easel of claim 15 including a first assembly and a second assembly, said first assembly disposed in said cover and including a first thumbscrew nut, said first thumbscrew nut adapted to cooperate with said first thumbscrew and attached to said first retaining member, and said second assembly including a second thumbscrew nut, said second thumbscrew nut adapted to cooperate with said second thumbscrew and attached to a first end of a spring, said spring being attached at a distal second end to said second retaining member and supplying a force thereto to urge said second retaining member toward said first retaining member.

18. The easel of claim 14 wherein said first slot and said second slot are disposed in parallel relation with respect to each other and are disposed on the same line.

19. The easel of claim 14 wherein said first slot and said second slot are disposed in parallel relation with respect to each other and are disposed a predetermined distance apart from each other.

20. An easel adapted for securing a panel thereto, comprising:

(a) a planar surface:

(b) a first protrusion disposed on said planar surface, said first protrusion providing an abutment that is adapted to engage one side of said panel;

(c) a second protrusion disposed on said planar surface at a predetermined distance from said first protrusion, said second protrusion providing an abutment that is adapted to engage a second side of said panel that is disposed opposite with respect to said one side; and (d) means for urging said second protrusion toward said first protrusion, said means for urging supplying a constant force urging said second protrusion toward said first protrusion;

whereby said panel is retained in position when it is disposed between said first protrusion and said second protrusion.

* * * * *